US006533279B2

(12) United States Patent
Moody et al.

(10) Patent No.: US 6,533,279 B2
(45) **Date of Patent: *Mar. 18, 2003**

(54) THREE CARD DRAW POKER GAMES

(75) Inventors: Ernest W. Moody, Las Vegas, NV (US); Kathlene A. Bouffleur, Las Vegas, NV (US)

(73) Assignees: Ernest Moody, Las Vegas, NV (US); Action Gaming, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/860,055

(22) Filed: May 16, 2001

(65) Prior Publication Data

US 2002/0185816 A1 Dec. 12, 2002

(51) Int. Cl.[7] ..... A63F 1/00; A63F 9/20
(52) U.S. Cl. ..... 273/292; 273/274; 463/13
(58) Field of Search ..... 273/292, 274; 463/11–13

(56) References Cited

U.S. PATENT DOCUMENTS

| | | | | |
|---|---|---|---|---|
| 5,489,101 | A | 2/1996 | Moody | |
| 5,531,448 | A | 7/1996 | Moody | 273/292 |
| 5,685,774 | A | 11/1997 | Webb | |
| 6,012,719 | A | 1/2000 | Webb | |

*Primary Examiner*—Benjamin H. Layno
*Assistant Examiner*—Vishu Mendiratta
(74) *Attorney, Agent, or Firm*—John Edward Roethel

(57) ABSTRACT

An initial hand of three cards is dealt to the player and three community cards are dealt face down. The player decides which cards to hold and which cards to discard. For each card that is discarded, the player uses one of the community cards as the replacement card. If the player discards one card, Card #1 is used as the replacement card. If the player discards two cards, Card #1 and Card #2 are used as the replacement cards. If the player discards all three cards, Card #1, Card #2 and Card #3 are used as the replacement cards. After the player has made his decision, all of the community cards are turned face up and the outcome of the player's final three card hand is determined. Winning and losing outcomes are determined based on a pay table and the amount of the player's wager.

8 Claims, 3 Drawing Sheets

THREE CARD DRAW POKER GAMES

This invention relates primarily to live casino table games and electronic video poker games, and more particularly to live casino table games and electronic video draw poker games that are based on three card poker hand rankings and which utilize community cards as replacement cards for cards discarded by the players.

BACKGROUND OF THE INVENTION

There has been a recent interest in three card poker games because these games can be played quickly and the player strategy is straightforward and much less complicated than the strategy required to play five card draw poker.

U.S. Pat. No. 5,685,774 discloses a game known as Three Card Poker. A player makes a first wager (the ANTE wager) to play against a dealer's hand and or the player makes a second wager (the PAIRPLUS wager) to play the hand value of the player's cards or the player makes both wagers. Using a single deck of playing cards, a three card hand is dealt to the player and a three card hand is dealt to the dealer. With regard to the ANTE wager, the player now must bet (the PLAY wager) or fold. If the player folds, he loses his ANTE wager. If the player bets, he plays his three card hand against the dealer's hand. If the dealer's hand does not qualify (lower than Queen High), player wins 1-to-1 odds on the ANTE wager and pushes on the PLAY wager. If the dealer qualifies by having a Queen High or better hand and if the player's hand beats the dealer's hand, player wins 1-to-1 odds on both the ANTE wager and on the PLAY wager. If the player's hand and the dealer's hand tie, the ANTE and the PLAY wager are a push and returned to the player.

As to the PAIRPLUS wager, only the player's hand is used and the player wins if the player has a Pair (1-to-1 odds), a Flush (4-to-1 odds), a Straight (6-to-1 odds), a Three-of a-Kind (30-to-1 odds) or a Straight Flush (40-to-1 odds). When playing Three Card Poker, the player may make the PAIRPLUS wager without making the ANTE or PLAY wager.

One of the drawbacks to this game is that the player must play only the three cards that he receives on the deal. If the player is dealt bad cards, the player has no chance of improving his hand during the course of play.

Another three card poker game is MULTI DECK THREE CARD POKER™. This game is played as an electronic video poker game in which the player makes three wagers and is dealt a three card hand. The player selects none, one or more of the three cards that have initially been dealt and each selected card is duplicated or re-used in two other hands. The unselected cards, if any, are discarded and replacement cards are dealt to each hand so that the player has three final three card hands. Winning and losing outcomes are determined based on a pay table and the amount wagered by the player.

The drawback to this game is that the player must make three wagers to be able to play all three hands. This game is also difficult to adapt to live casino table play since the selected cards must be re-used in each of the three hands.

U.S. Pat. No. 5,489,101 discloses a five card draw poker game in which the replacement cards are provided from particular preselected card locations. As shown in FIG. 1 of this patent, the potential replacement cards are arranged in three horizontal rows formed in a triangular outline with one card in the bottom row, two cards in the center row and three cards in the top row. The player makes a wager and is dealt an initial hand of five cards. The player may discard and draw from zero to five replacement cards. If the player discards and draws one card, the one replacement card is the single card in the bottom row. If the player discards and draws two cards, the two replacement cards are the two cards in the center row. If the player discards and draws three cards, the three replacement cards are the three cards in the top row. If the player discards and draws four cards, the four replacement cards are the one card in the bottom row and the three cards in the bottom row. Finally, if the player discards and draws all five cards, the five replacement cards are the two cards in the center row and the three cards in the top row. The poker hand ranking of the final five cards is determined and the player much have achieved one of the predetermined poker hand rankings in order to have a winning hand. The payout for a winning hand is based on a pay table and the amount of the player's wager.

The drawback to this game is that it plays slowly since each player at the table must receive five cards and determine which cards to hold and discard. The dealer must arrange the Six replacement cards and make sure that each player's replacement cards come from the correct grouping of cards on the table layout. There are many possible final hand arrangements and the dealer must be sure to analyze each player hand correctly to determine whether it is a winning or losing hand and the poker hand ranking of each winning hand.

It is an object of the present invention to provide a three card poker game that can easily be played in a live table game format. It is a further object of the present invention to provide a three card poker game that can be played quickly and is easily learned with a straightforward player strategy so that the method of play will not be intimidating to even the novice player.

It is a feature of the present invention that each player makes a wager and is dealt three initial cards. Three face down cards are also dealt as community cards. Each player discards none, one, two or all three of his initial cards and replacement cards are provided from the community cards. Winning hands are determined by a pay table and there are only a few possible winning hand endings which makes it easy for the dealer to analyze.

It is an advantage of the present invention that a fast-paced live casino table game is provided. The game is easy to play and easy to deal. The use of the community cards as replacement cards allows the player the opportunity to improve any initially dealt hands that are not good hands.

Other objects, features and advantages of the present invention will become apparent from a consideration of the following detailed description.

SUMMARY OF THE INVENTION

The method of present invention involves the player making a wager to play a three card poker hand. Once the player has made his wager, an initial hand of three cards is dealt to the player. After the player's hand is dealt, three community cards are dealt face down.

The player looks at his initial three cards and decides which cards to hold and which cards to discard. For each card that is discarded, the player uses the appropriate pre-designated community card as the replacement card. In the preferred embodiment of the present invention, the community cards are designated as Card #1, Card #2 and Card #3. If the player discards one card, Card #1 is used as the replacement card. If the player discards two cards, Card #1 and Card #2 are used as the replacement cards. If the player discards all three cards, Card #1, Card #2 and Card #3 are used as the replacement cards.

After the player has made his decision as to how many cards he will discard, if any, all of the community cards are turned face up and the outcome of the player's final three card hand is determined. Winning and losing outcomes are determined based on a pay table showing the winning three card poker hand rankings and winning players are paid based on the amount of the player's wager.

DETAILED DESCRIPTION OF THE PREFERRED EMBODIMENTS

The present invention is preferably played as a live casino table game. Alternatively, the present invention can be played on an electronic video gaming machine programmed to replicate the live casino table game method described herein. Any suitable gaming table configuration can be used, such as a conventional Twenty-One table with the gaming table layout modified for use with the method of play of the present invention.

Figure 1:
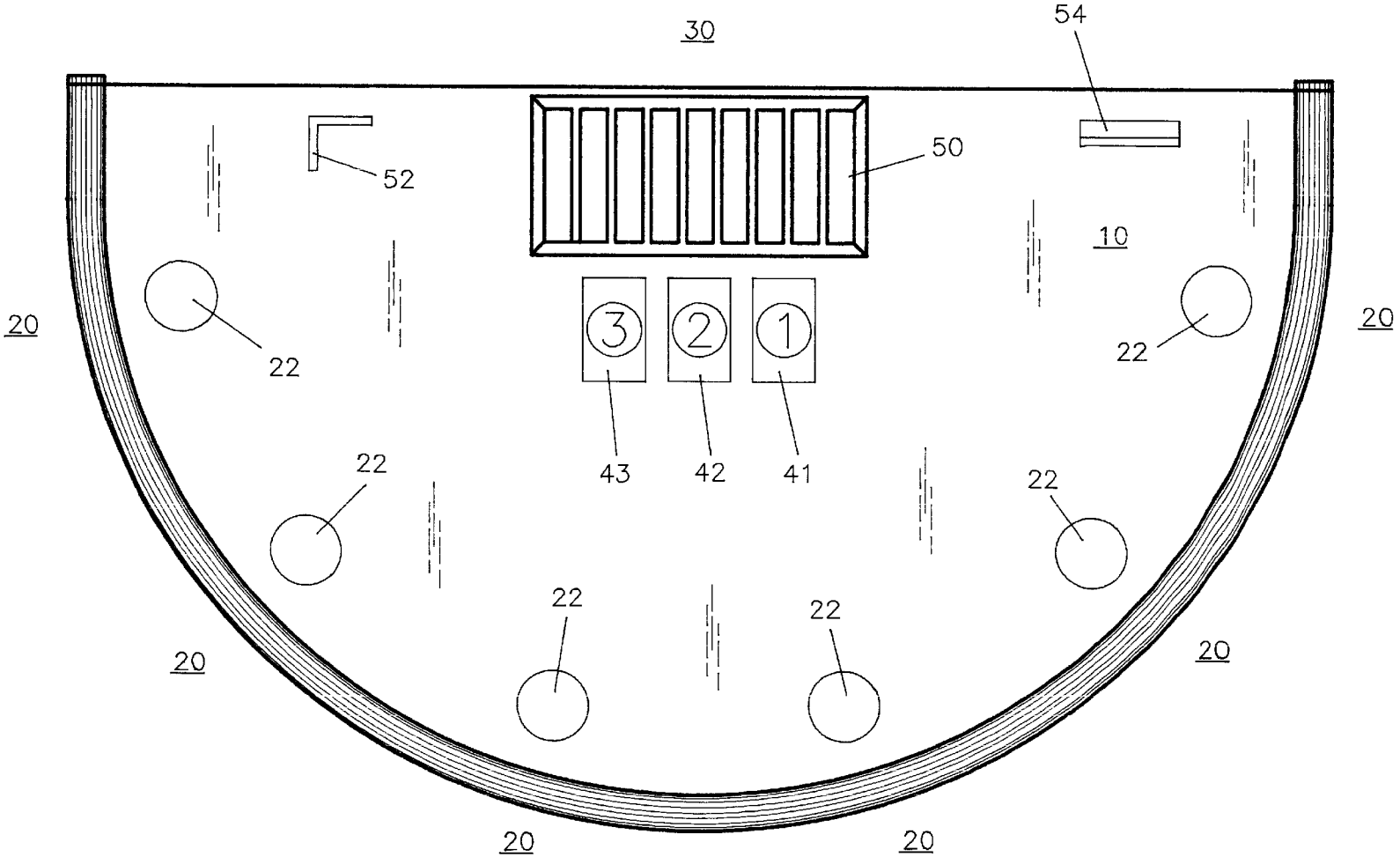
FIG. 1 shows a gaming table layout on which the method of the present invention can be played.

FIG. 1 shows schematically a suitable gaming table layout 10 which includes a plurality of player locations 20 and a dealer location 30. Each player location 20 has a wagering spot 22. Adjacent to the dealer location 30 are card locations for the placement of the three community cards—Card #1 at location 41, Card #2 at location 42 and Card #3 at location 43.

A conventional chip rack 50 and a discard shoe 52 are also provided. An information display card 54 can be placed on the gaming table layout 10 to provide the players with payout information and other rules of play of the game.

At the beginning of each round of play, each player makes a wager to play his three card poker hand. The wager can be any suitable amount from the minimum to the maximum amount allowed by the gaming casino. In the preferred embodiment of the present invention, a standard fifty-two card deck of playing cards is used. The dealer shuffles the cards in order to effect a random distribution of the cards throughout the deck.

Once each player has made his wager, an initial hand of three cards is dealt to each player in any suitable manner. After each player's hand is dealt, three community cards are dealt face down and placed at the appropriate card locations 41, 42 and 43. The dealing of the community cards can be interspersed with the dealing of the player cards in any suitable manner.

For example, the dealing of the card may be effected by dealing one card in turn to each player around the gaming table. After each player receives his three cards, the next three cards in the deal can be used as the community cards. Alternatively, after each player receives his first card, the first community card is dealt; then each player receives his second card, followed by the second community card being dealt; and finally each player receives his third card and then the third community card is dealt. As another alternative way of dealing the cards, all three community cards can be dealt first followed by dealing the player cards. There is nothing critical about the manner in which the cards are dealt, since the shuffling of the cards prior to the commencement of the deal insures that the cards are dealt randomly to each player and the community card locations.

Each player looks at his cards and decides which cards to hold and which cards to discard. For each card that is discarded, the player uses one of the community cards as the replacement card. In the preferred embodiment of the present invention, the community cards are designated as Card #1, Card #2 and Card #3. If the player discards one card, Card #1 is used as the replacement card. If the player discards two cards, Card #1 and Card #2 are used as the replacement cards. If the player discards all three cards, Card #1, Card #2 and Card #3 are used as the replacement cards.

After the player has made his decision as to how many cards he will discard, if any, all of the community cards are turned face up and the outcome of the player's final three card hand is determined. Winning and losing outcomes are determined based on a pay table showing the winning three card poker hand rankings and winning players are paid based on the amount of the player's wager.

Any suitable pay table may be used based on the mathematical probability of achieving the various final three card hands. A representative pay table is shown in Table 1.

TABLE 1

| Poker Hand Ranking | Payout Odds |
|---|---|
| Pair of 2's or less | Losing Hand |
| Pair of 3's thru Aces | 1 for 1 |
| Straight | 1 to 1 |
| Flush | 2 to 1 |
| Straight Flush | 10 to 1 |
| Royal Flush | 15 to 1 |

EXAMPLE A

Figure 2:
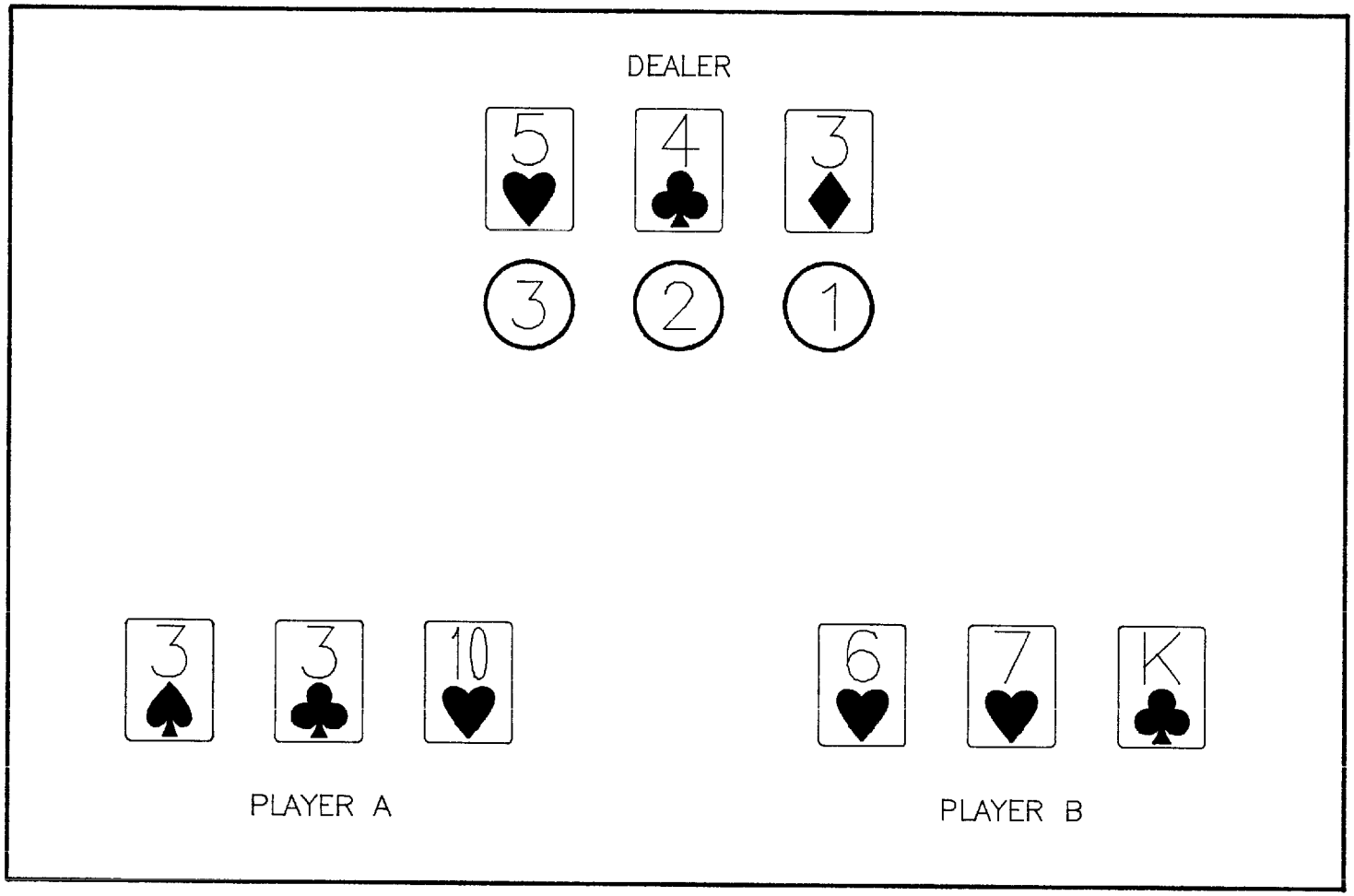
FIG. 2 shows an example of a play of the method of the present invention.

Player A and Player B both make a $10 wager and the dealer deals three cards to each player. As shown in FIG. 2, Player A receives the Three of Spades, the Three of Clubs and the Ten of Hearts. Player B receives the Six of Hearts, the Seven of Hearts and the King of Clubs.

The dealer deals three cards to the community card positions; all of the community cards are initially dealt face down.

Each player then decides which of his cards he wishes to discard, if any. Following along with this example, Player A would probably discard the Ten of Hearts and hold the Three of Spades and the Three of Clubs. Player B would probably discard the King of Clubs and hold the Six of Hearts and the Seven of Hearts.

After each player has discarded his unwanted cards, the dealer then turns over the community cards. Following along with this example as shown in FIG. 2, the community cards are revealed with Card #1 being the Three of Diamonds, Card #2 being the Four of Clubs and Card #3 being the Five of Hearts.

If a player does not discard any of his initial cards, then none of the community cards are used in the player's hand and the player's three initial cards form the player's final three card hand. If a player discards one of his initial cards, then Card #1 of the community cards is used in the player's hand to complete the player's final three card hand. If a player discards two of his initial cards, then Card #1 and Card #2 of the community cards are used in the player's hand to complete the player's final three card hand. If a player discards all of his initial cards, then Card #1, Card #2 and Card #3 of the community cards are used in the player's hand to complete the player's final three card hand.

Following along with this example, Card #1 is used in Player A's hand and the final three card hand for Player A is three Three's. Using pay table 1, Player A has a winning final hand and would be awarded one for one odds on his $10 wager (Player A receives back his $10).

Player B also uses Card #1 in his hand to complete his final three card hand and Player B would have a losing hand and would lose his $10 wager.

EXAMPLE B

Figure 3:
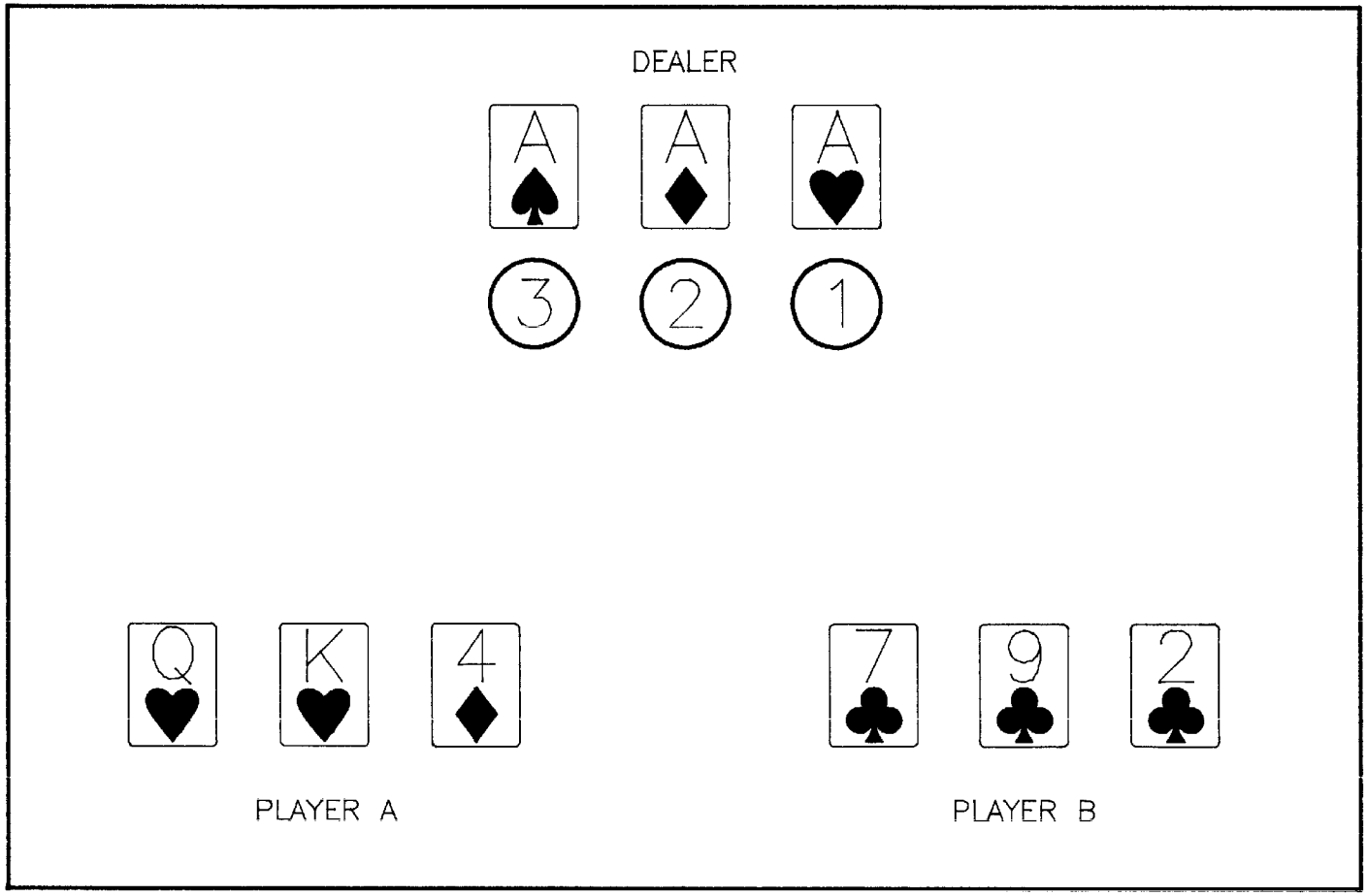
FIG. 3 shows another example of a play of the method of the present invention.

Player A wagers $5 and receives the Queen of Hearts, the King of Hearts and the Four of Diamonds. As shown in FIG. 3, Player A discards the Four of Diamonds. Player B wagers $20 and receives the Seven of Clubs, the Nine of Clubs and the Two of Clubs. Player B discards no cards and stands on his Flush.

The community cards are dealt and Card #1 is the Ace of Hearts, Card #2 is the Ace of Diamonds and Card #3 is the Ace of Spades as shown in FIG. 3.

Using Card #1 in Player A's hand results in a final hand for Player A that is a Royal Flush. Player A is awarded 15 to 1 odds on his $5 wager. Player B had stood on his initial three cards so Player B's final hand is a Flush and Player B is awarded 2 to 1 odds on his $20 wager.

The method of the present invention may also include an additional betting feature based on just the three community cards. In order to add this additional betting feature, a player may make a second wager which is determined based on the poker hand ranking of just the three community cards—Card #1 41, Card #2 42 and Card #3 43. These three cards play as a three card stud hand without any replacement cards being provided for these three cards.

The payout table for this additional betting feature of the three card stud hand is shown in Table 2.

TABLE 2

| Poker Hand Ranking | Payout Odds |
|---|---|
| Pair of 2's or less | Losing Hand |
| Pair of 3's thru Aces | 1 to 1 |
| Straight | 2 to 1 |
| Flush | 4 to 1 |
| Straight Flush | 20 to 1 |
| Royal Flush | 30 to 1 |

With reference to Example A as shown in FIG. 2, any player making this second wager would have be awarded 2 to 1 odds on this wager since the three community cards formed a Straight.

With reference to Example B as shown in FIG. 3, any player making this second wager would have be awarded 1 to 1 odds on this wager since the three community cards formed a Three-of a-Kind.

The method of the present invention may also be modified to include wild cards. Either one or more cards (such as all of the Deuces or all of the Sevens or both of the One-Eyed Jacks) may be designated as wild cards. Alternatively, one or more additional cards, such as Jokers, may be added to the standard fifty-two card deck and these additional cards may be designated as wild cards. Any pay tables used in connection with the method of play of the present invention would be modified as needed to accommodate the different mathematical probabilities which would occur on account of the use of wild cards.

The preferred embodiment of the present invention has been described in the context of a live casino table game. Alternatively, the method of the present invention may be practiced on an electronic video gaming machine configured as a single player game or as a multi-player game.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a poker-style game using a standard deck of playing cards comprising:

a) dealing an initial hand consisting of three cards to each player and dealing face down a group of community cards consisting of a first community card, second community card and a third community card;

b) permitting the player to discard none, one, two or three cards from the player's initial hand;

c) displaying each of the community cards face up;

d) if the player discards one card, using the first community card as a replacement card to complete a player's final hand;

e) if the player discards two cards, using the first community card and the second community card as replacement cards to complete a player's final hand;

f) if the player discards three cards, using the first community card, the second community card and the third community card as replacement cards to complete a player's final hand; and g) determining the poker hand ranking of the player's final hand.

2. The method of claim 1 in which the player makes a wager to participate in the method of play and providing the player with an award based on the poker hand ranking of the player's final hand.

3. The method of claim 2 in which the award is determined by a pay table and the amount of the player's wager.

4. The method of claim 3 in which the pay table is:

| Poker Hand Ranking | Payout Odds |
|---|---|
| Pair of 2's or less | Losing Hand |
| Pair of 3's thru Aces | 1 for 1 |
| Straight | 1 to 1 |
| Flush | 2 to 1 |
| Straight Flush | 10 to 1 |
| Royal Flush | 15 to 1 |

5. The method of claim 1 further including determining the poker hand ranking of the group of community cards.

6. The method of claim 5 in which the player makes wager on the poker hand ranking of the group of community cards and the player receives an award if the group of community cards forms a winning poker hand ranking.

7. The method of claim 6 in which the amount of the award is based on a pay table and the amount of the player's wager.

8. The method of claim 7 in which the pay table is:

| Poker Hand Ranking | Payout Odds |
|---|---|
| Pair of 2's or less | Losing Hand |
| Pair of 3's thru Aces | 1 to 1 |
| Straight | 2 to 1 |
| Flush | 4 to 1 |
| Straight Flush | 20 to 1 |
| Royal Flush | 30 to 1 |

* * * * *